US006805430B2

(12) United States Patent
Chen et al.

(10) Patent No.: US 6,805,430 B2
(45) Date of Patent: Oct. 19, 2004

(54) INKJET APPARATUS AND METHOD OF PREVENTING MISPLACING INKJET CARTRIDGE THEREIN

(75) Inventors: Chih-Ching Chen, Taipei (TW); Yi-Jing Leu, Hsinchu (TW); Der-Rong Shyu, Putz (TW)

(73) Assignee: Benq Corporation, Taoyuan (TW)

( * ) Notice: Subject to any disclaimer, the term of this patent is extended or adjusted under 35 U.S.C. 154(b) by 8 days.

(21) Appl. No.: 10/253,543

(22) Filed: Sep. 25, 2002

(65) Prior Publication Data

US 2003/0058304 A1 Mar. 27, 2003

(30) Foreign Application Priority Data

Sep. 25, 2001 (TW) ..... 90123658 A

(51) Int. Cl.[7] ..... B41J 2/21; B41J 2/175
(52) U.S. Cl. ..... 347/43; 347/86
(58) Field of Search ..... 347/43, 19, 50, 347/58, 37

(56) References Cited

U.S. PATENT DOCUMENTS 4,432,005 A 2/1984 Duffield et al. ..... 347/86
5,728,450 A 3/1998 Kouzai et al. ..... 428/32.76
5,767,988 A * 6/1998 Dobbs et al. ..... 358/474
6,467,869 B1 * 10/2002 Merz et al. ..... 347/19
6,161,915 A1 12/2002 Bolash et al. ..... 347/19

FOREIGN PATENT DOCUMENTS

DE 19954750 5/2001
EP 1114726 A1 7/2001

* cited by examiner

*Primary Examiner*—Thinh Nguyen
(74) *Attorney, Agent, or Firm*—Rabin & Berdo, P.C.

(57) ABSTRACT

An inkjet apparatus and a method of preventing misplacing the inkjet cartridge therein are disclosed. The inkjet apparatus comprises a carriage, a control unit and a sensor. The carriage is equipped with at least an inkjet cartridge that has an identifiable area. The color of the identifiable area is associated with the colors of ink stored in the inkjet cartridge. The sensor detects the color of the identifiable area and sends a signal to the control unit. The control unit receives the signal and determines whether the inkjet cartridge is correctly placed. If the inkjet cartridge is misplaced, a warning signal is generated to alert the user.

38 Claims, 3 Drawing Sheets

INKJET APPARATUS AND METHOD OF PREVENTING MISPLACING INKJET CARTRIDGE THEREIN

This application incorporates by reference of Taiwan application Serial No. 90123658, filed Sep. 25, 2001.

BACKGROUND OF THE INVENTION

1. Field of the Invention

The invention relates in general to an inkjet apparatus and a method of preventing misplacing an inkjet cartridge therein, and more particularly to the method of preventing misplacing the inkjet cartridge by using a sensor to detect the color of an identifiable area of inkjet cartridge disposed in the carriage.

2. Description of the Related Art

The inkjet apparatus, such as copy machine, facsimile machine and inkjet printer, has become a necessity in the modern life. Recently, a multi-function printer (MFP) that combines the multiple functions (like copy machine, facsimile machine and inkjet printer) has been designed to meet the demands of the consumers all at once. It is very easy and time saving for the users to connect the inkjet printer to the computer and print out the documents/pictures/photos. The inkjet printer mainly includes a housing and a printing module situated inside the housing to perform the printing steps. The details of the printing module are described as follows.

FIG. 1 is a schematic drawing of a conventional printing module in the inkjet apparatus. The printing module 100 includes a carriage 102, a rod 104, a print platform 106 and the sidewalls 108*a* and 108*b*. The sidewalls 108*a* and 108*b* are set oppositely, and two ends of the rod 104 are respectively connected to the sidewalls 108*a* and 108*b*. The carriage 102, removably arranged on the rod 104, can move forward or backward over the print platform 106 along the direction of arrow 105, to accomplish the printing operation. The carriage 102 comprises the printed circuit boards (PCBs) 110*a* and 110*b*, the cartridge-setting slots 112*a* and 112*b* for placing the inkjet cartridges 114*a* and 114*b* therein. Also, there are flexible PCBs 116*a* and 116*b* attached at the surfaces 115*a* and 115*b* of the inkjet cartridges 114*a* and 114*b*, respectively. When the inkjet cartridges 114*a* and 114*b* are respectively put into the cartridge-setting slots 112*a* and 112*b*, the flexible PCBs 116*a* and 116*b* could electrically couple to the PCBs 110*a* and 110*b* at the carriage 102; therefore, the current conducted into the flexible PCBs 116*a* and 116*b* through the PCBs 110*a* and 110*b* and the printer could control the movement of the carriage 102 and drive the inkjet cartridges 114*a* and 114*b* to eject ink.

Generally, two inkjet cartridges are adapted in a printing module 100. One is a single-color cartridge 114*b*, usually filled with black ink. The other is a color cartridge 114*a*, having separated ink reservoirs and filled with different color inks such as cyan, magenta, and yellow ink. In the commercial inkjet printer market, there are other colors of ink to be used, such as light black, light cyan, light magenta, and light yellow.

However, the similar external appearances of the conventional homochromatic cartridge and the color cartridge confuse the user all the time. Consequently, the misplacement of cartridges in the carriage 102 occurs and it has effect on the printing result. In order to put the homochromatic cartridge 114*b* and the color cartridge 114*a* into the correct positions at the carriage 102, which means that the flexible PCBs 116*a* and 116*b* are electrically coupled to the PCBs 110*a* and 110*b*, some manufacturers try to make a difference between both cartridges; for example, a difference in size. As shown in FIG. 1, the size of the cartridge 114*a* is larger than that of the cartridge 114*b*; correspondingly, the space of cartridge setting slot 112*a* is larger than that of the cartridge setting slot 112*b*. The inkjet cartridge can only be installed in the size-matched cartridge setting slot. Accordingly, the misplacement of cartridge can be prevented.

Also, some manufacturers make an improvement in the configuration of the cartridge, so that the user can visually distinguish the cartridge model and its matched cartridge setting slot. However, the cartridges are usually produced into a whole. Change the configuration of the cartridge will raise the production cost.

SUMMARY OF THE INVENTION

It is therefore an object of the invention to provide an inkjet apparatus and a method of preventing misplacing inkjet cartridge therein. At least a sensor is used to detect the color of the identifiable area at the inkjet cartridge and then send a signal to a control unit. It is very convenient that the control unit can determine whether the inkjet cartridge is misplaced and alerts the user to the misplaced condition.

It is an object of the invention to provide an inkjet apparatus, having a carrier equipped with at least one inkjet cartridge. The inkjet cartridge has an identifiable area, and the color of the identifiable area is associated with the colors of ink stored in the inkjet cartridge. The inkjet apparatus comprises a control unit and a sensor. The sensor detects the color of the identifiable area and sends a signal to the control unit. The control unit receives the signal and determines whether the inkjet cartridge is correctly placed.

It is another object of the invention to provide a method of preventing misplacing inkjet cartridge. The method is adapted to an inkjet apparatus. The inkjet apparatus has a carriage, a sensor and a control unit. The carriage is equipped with an inkjet cartridge, and the inkjet cartridge has an identifiable area, which the color of the identifiable area is associated with the color of ink stored in the inkjet cartridge. The method comprises the steps of: (1) detecting the color of the identifiable area and sending a signal by the sensor; and (2) receiving the signal and telling whether the inkjet cartridge is placed in the right position by the control unit. If the inkjet cartridge is misplaced, a warning signal is send to alert the user.

It is still another object of the invention to provide an inkjet apparatus having a carriage equipped with a first printed circuit board (PCB) and a second PCB. When a first inkjet cartridge and a second inkjet cartridge are placed in the carriage, a first flexible PCB of the first inkjet cartridge and a second flexible PCB of the second inkjet cartridge are electrically coupled to the first PCB and the second PCB of the carriage, respectively. The first flexible PCB and the second flexible PCB respectively have a first identifiable area and a second identifiable area, wherein the colors of the first identifiable area and the second identifiable area are associated with the colors of ink stored in the first inkjet cartridge and the second inkjet cartridge. The inkjet apparatus comprises a first sensor, a second sensor and a control unit. The first sensor is positioned at the carriage for detecting the color of the first identifiable area and sending a first signal. The second sensor is positioned at the carriage for detecting the color of the second identifiable area and sending a second signal. The control unit receives the first signal and the second signal and determines whether the first inkjet cartridge and the second inkjet cartridge are correctly placed in the right positions.

It is still another object of the invention to provide a method of preventing misplacing inkjet cartridge, and the method is adapted to an inkjet apparatus. The inkjet apparatus has a carriage, a first sensor, a second sensor, and a control unit. The carriage is equipped with a first PCB and a second PCB. When a first inkjet cartridge and a second inkjet cartridge are placed in the carriage, a first flexible PCB of the first inkjet cartridge and a second flexible PCB of the second inkjet cartridge are electrically coupled to the first PCB and the second PCB of the carriage, respectively. The first flexible PCB and the second flexible PCB respectively have a first identifiable area and a second identifiable area, wherein the colors of the first identifiable area and the second identifiable area are associated with the colors of ink filled in the first inkjet cartridge and the second inkjet cartridge. The method comprises the steps of: (1) detecting the colors of the first identifiable area and the second identifiable area, and sending a first signal and a second signal by the first sensor and the second sensor, respectively; and (2) receiving the first signal and the second signal, and determining whether the first inkjet cartridge and the second inkjet cartridge are correctly placed in the right positions by the control unit. If the inkjet cartridges are misplaced, a warning signal is send to alert the user.

Other objects, features, and advantages of the invention will become apparent from the following detailed description of the preferred but non-limiting embodiment. The following description is made with reference to the accompanying drawings.

DETAILED DESCRIPTION OF THE INVENTION

An inkjet apparatus and a method of preventing misplacing the inkjet cartridge in the inkjet apparatus are disclosed. The inkjet apparatus mainly includes a housing and a printing module. The printing module situated inside the inkjet apparatus includes a control unit and a carriage. At least an inkjet cartridge is equipped in the carriage, wherein the cartridge has an identifiable area and its color is corresponding to the color of ink stored in the cartridge. In the invention, a sensor is used to detect the identifiable area at the inkjet cartridge, and then send a signal to the control unit that determines whether the inkjet cartridge is misplaced and alerts the user to the misplaced condition. The inkjet apparatus could be an inkjet printer, inkjet facsimile machine, inkjet copy machine, or multi-function printer (MFP) combining the functions thereof. The sensor used in the inkjet apparatus could be a charged coupling device (CCD), or contact image sensor (CIS). In this preferred embodiment, the printing module equipped with two inkjet cartridges in the inkjet apparatus of the invention is taken for illustration, and the details are described below.

Figure 1:
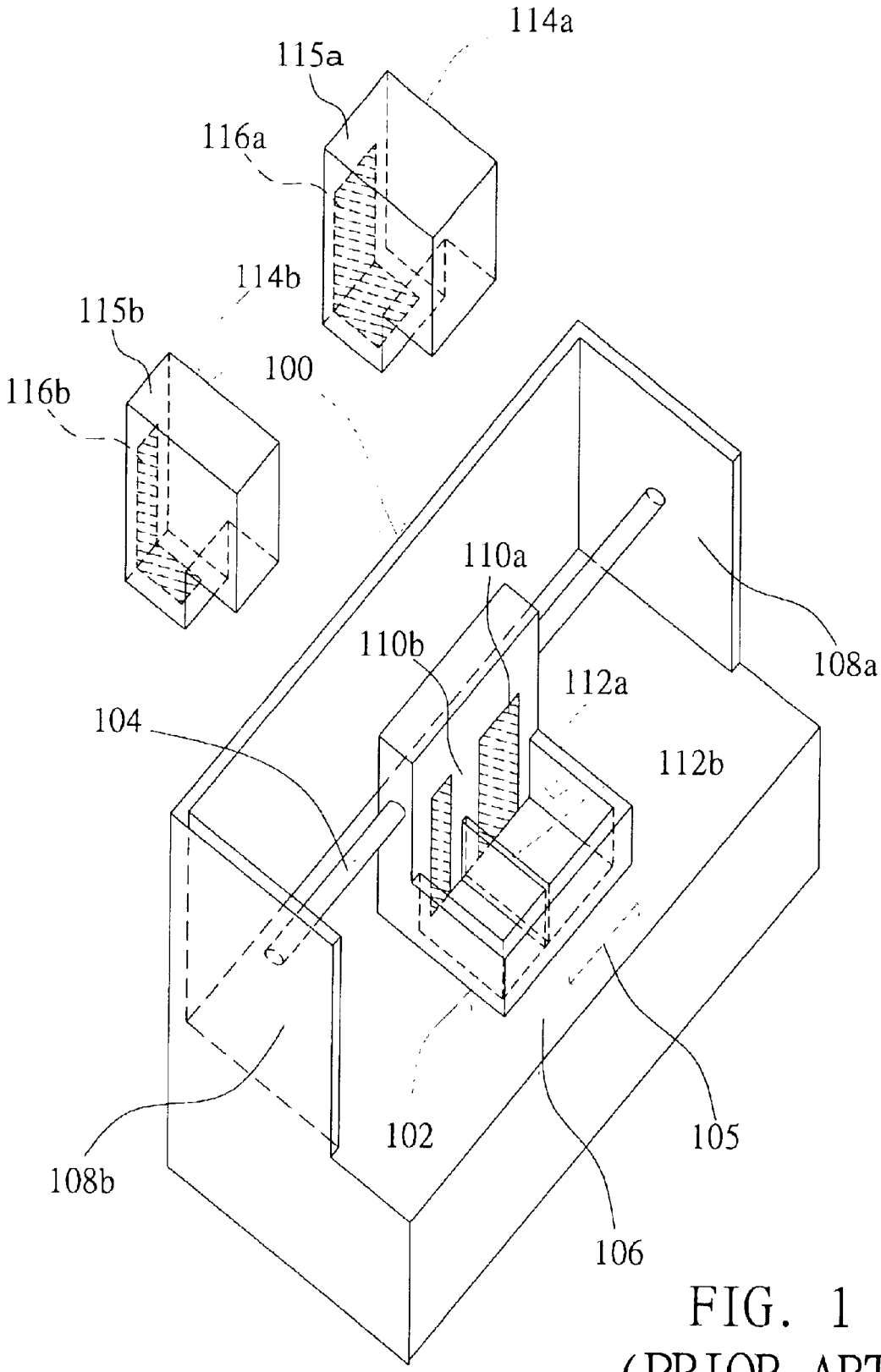
FIG. 1 (PRIOR ART)
FIG. 1 (Prior Art) is a schematic drawing of a conventional printing module in the inkjet apparatus.
Figure 2:
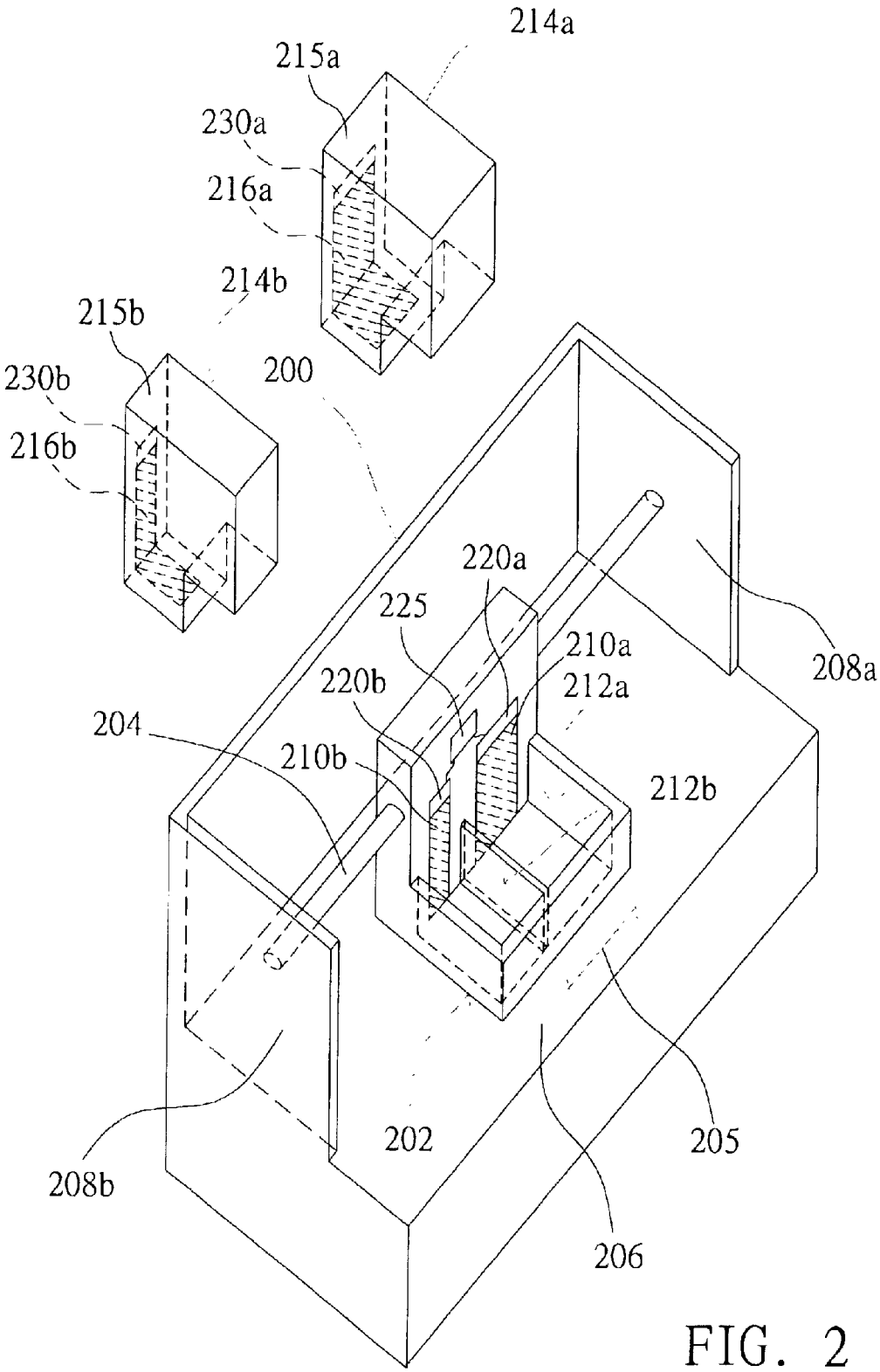
FIG. 2 is a schematic drawing of a printing module in the inkjet apparatus according to the preferred embodiment of the invention.

FIG. 2 is a schematic drawing of a printing module in the inkjet apparatus according to the preferred embodiment of the invention. The printing module 200, situated inside the housing of the inkjet apparatus, includes a carriage 202, a rod 204, a print platform 206 and the sidewalls 208*a* and 208*b*. The sidewalls 208*a* and 208*b* are set oppositely, and two ends of the rod 204 are respectively connected to the sidewalls 208*a* and 208*b*. The carriage 202, removably mounted on the rod 204, can move forward or backward over the print platform 206 along the direction of arrow 205 during printing operation. The carriage 202 comprises a control unit 225, the sensors 220*a* and 220*b*, the printed circuit boards (PCBs) 210*a* and 210*b*, the cartridge-setting slots 212*a* and 212*b* for receiving the inkjet cartridges 214*a* and 214*b*. Also, there are flexible PCBs 216*a* and 216*b* attached at the surfaces 215*a* and 215*b* of the inkjet cartridges 214*a* and 214*b*, respectively. Alternatively, the PCBs 210*a* and 210*b* could be designed as one integrated PCB.

When the inkjet cartridges 214*a* and 214*b* are respectively put into the cartridge-setting slots 212*a* and 212*b*, the flexible PCBs 216*a* and 216*b* could electrically couple to the PCBs 210*a* and 210*b* at the carriage 202; therefore, the currents conducted into the flexible PCBs 216*a* and 216*b* through the PCBs 210*a* and 210*b*, and the printer could control the movement of the carriage 202 and drive the inkjet cartridges 214*a* and 214*b* to eject ink. If the user misplaces the cartridges 214*a* and 214*b* into the wrong slots (212*a* and 212*b*), the printing operation is terminated and not to be performed.

In this preferred embodiment, the cartridge 214*b* is a single-color cartridge filled with black ink, while the cartridge 214*a* is a color cartridge filled with three different colors of ink such as cyan, magenta and yellow. In the practical application, the color of ink filled in the cartridge could optionally be cyan, magenta, yellow, light black, light cyan, light magenta and light yellow. Additionally, the identifiable areas 230*a* and 230*b* are further formed at the flexible PCBs 216*a* and 216*b*, and designed for helping the user tell the color of ink in the cartridge. The colors of the identifiable areas 230*a* and 230*b* are associated with the colors of ink in the cartridges 214*a* and 214*b*, respectively. Also, the identifiable areas 230*a* and 230*b* could be formed by adding the related colorants on the flexible PCBs during the flexible PCB fabrication. Therefore, the user immediately knows the colors of ink in the cartridges 214*a* and 214*b* by looking at the identifiable areas 230*a* and 230*b*. Although the identifiable areas 230*a* and 230*b* in FIG. 2 only take parts of the spaces in the flexible PCBs 216*a* and 216*b*, the areas could be optionally changed. For example, the identifiable areas 230*a* and 230*b* could have the identical size with the flexible PCBs 216*a* and 216*b*.

Figure 3:
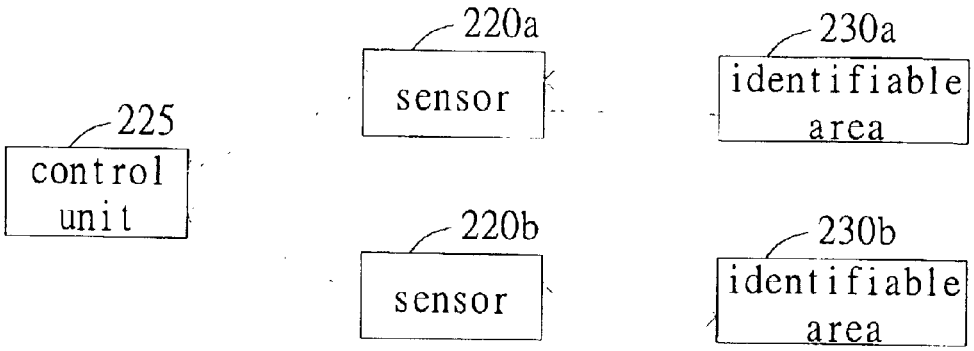
FIG. 3 shows the connections between the control unit, sensors and identifiable areas.

Moreover, the control unit 225, and the sensors 220*a* and 220*b* are further equipped at the carriage 202 to prevent the misplacement of the cartridge. The sensors 220*a* and 220*b*, respectively positioned at the PCBs 210*a* and 210*b*, are electrically connected to the control unit 225. FIG. 3 shows the connections between the control unit, sensors and identifiable areas. The sensors 220*a* detects the color of the identifiable area 230*a*, and send a first signal to the control unit 225. Similarly, the sensors 220*b* detects the color of the identifiable area 230*b*, and send a second signal to the control unit 225. The control unit 225 receives the first signal and the second signal from the sensors 220*a* and 220*b*, whereby the placements of the inkjet cartridges 214*a* and 214*b* in the carriage 202 can be determined. Alternatively, the control unit 225 could be set on the main board (not shown) of the inkjet apparatus instead of at the carriage 202.

Figure 4:
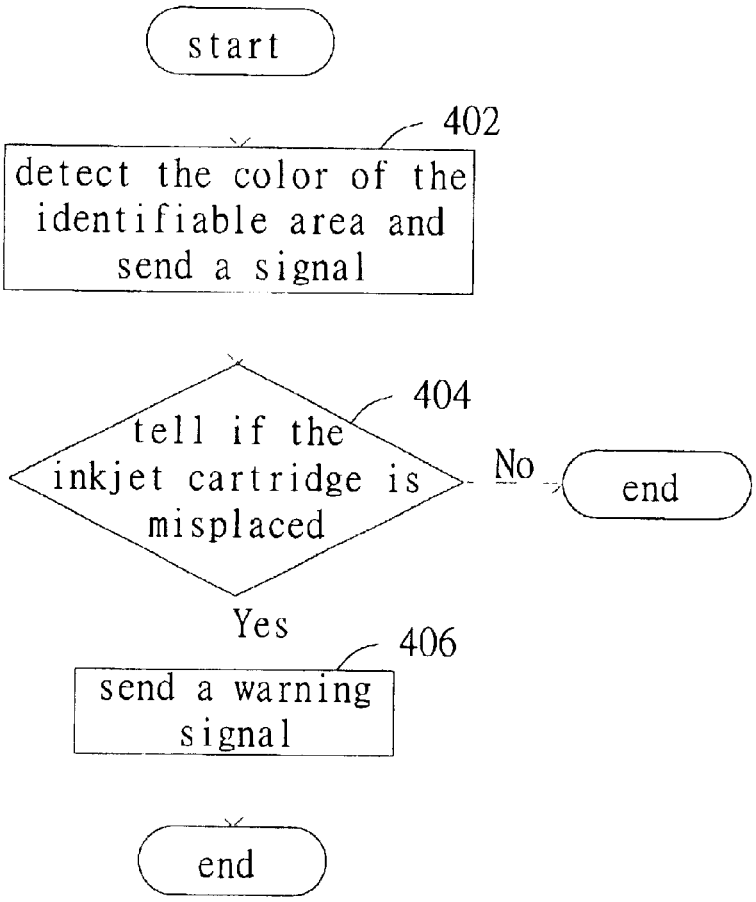
FIG. 4 is a flow chart representing a method of preventing the misplacement of inkjet cartridge according to the preferred embodiment of the invention.

FIG. 4 is a flow chart representing a method of preventing the misplacement of inkjet cartridge according to the preferred embodiment of the invention. In step 402, the sensors 220*a* and 220*b* respectively detect the colors of the identifiable area 230*a* and 230*b*, and then transmit the first signal and the second signal. Then, the control unit receives the first and the second signals, and determines whether the inkjet cartridges 214*a* and 214*b* are correctly placed at the right positions. If the determination is positive (the cartridges are at right positions), the printing operation is allowed to proceed and this process ends; otherwise, the system is led to step 406. When the inkjet cartridges 214*a* and 214*b* are misplaced at the slots 212*b* and 212*a*, the control unit 225 would send a warning signal like a sound or a sign to alert the user. So, both of the inkjet cartridges could be switched or changed.

Although the identifiable areas formed by the chemical method such as adding the colorants in the flexible substrate of PCB is illustrated in this preferred embodiment, the invention is not limited herein. The color tags can be directly attached to a surface of the housing of the cartridges, wherein the attached positions are corresponding to the sensors' positions and the tag colors are associated with the ink colors. Since the carriage usually moves to the home position while the printer is on, both of the sensors could be arranged at the inner wall of the housing of printer and quite near the home position, to detect the identifiable areas at the cartridges. Alternatively, the detection of identifiable area could be accomplished by one removable sensor instead of two fixed sensors. Also, the signals between the sensors to the control unit could be transmitted/received by the wireless method, such as infrared (IR) data association, RF transmission or radio transmission.

Moreover, several models of the inkjet cartridges can be differentiated by the different colors of the identifiable areas. For example, one model has a black identifiable area while the other model has a gray identifiable area, so as to differentiate the different models of the inkjet cartridges both containing black ink. Hence, the user will understand if the right model of cartridge is adopted in the inkjet apparatus.

In summary, the sensor of the invention is used to detect the identifiable area at the inkjet cartridge, and then send a signal to the control unit that determines whether the inkjet cartridge is misplaced and informs the user. Accordingly, neither the differentiable size of the cartridges or the matched appearance of the placing slots is required for preventing misplacing inkjet cartridges. Whether the inkjet cartridges are misplaced is only determined by the detection of the sensor. Consequently, the cost of pattern-making in the present invention can be decreased.

While the invention has been described by way of example and in terms of preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. An inkjet apparatus, having a carriage equipped with a printed circuit board (PCB), a first flexible PCB and a second flexible PCB respectively disposed in a first inkjet cartridge and a second inkjet cartridge electrically coupling to the PCB on the carriage, the first inkjet cartridge and the second inkjet cartridge respectively having a first identifiable area and a second identifiable area, wherein the colors of the first identifiable area and the second identifiable area are associated with the colors of ink stored in the first inkjet cartridge and the second inkjet cartridge, the inkjet apparatus comprising:

a first sensor, disposed in the carriage for detecting the color of the first identifiable area and sending a first signal;

a second sensor, disposed in the carriage for detecting the color of the second identifiable area and sending a second signal; and a control unit for receiving the first signal and the second signal, and determining whether the first inkjet cartridge and the second inkjet cartridge are correctly placed.

2. The inkjet apparatus according to claim 1, wherein the control unit sends a warning signal to alert a user when the first inkjet cartridge or the second inkjet cartridge is misplaced.

3. The inkjet apparatus according to claim 1, wherein the carriage is equipped with a first printed circuit board (PCB) and a second PCB, wherein the first PCB and the second PCB are electrically coupled to the first flexible PCB of the first inkjet cartridge and the second flexible PCB of the second inkjet cartridge, respectively.

4. The inkjet apparatus according to claim 3, wherein the first sensor and the second sensor are positioned at the first PCB and the second PCB, respectively.

5. The inkjet apparatus according to claim 1 further comprising a housing, wherein the first sensor and the second sensor are disposed in an inside wall of the housing.

6. The inkjet apparatus according to claim 1, wherein the first identifiable area and the second identifiable area are formed at the first flexible PCB of the first inkjet cartridge and the second flexible PCB of the second inkjet cartridge, respectively.

7. The inkjet apparatus according to claim 1, wherein the first inkjet cartridge has a first surface and the second inkjet cartridge has a second surface, wherein the first identifiable area and the second identifiable area are located at the first surface and the second surface, respectively.

8. The inkjet apparatus according to claim 1, wherein the first signal and the second signal are wirelessly transmitted between the control unit, the first sensor and the second sensor.

9. The inkjet apparatus according to claim 1, wherein the colors of the first identifiable area and the second identifiable area are identical to the colors of ink stored in the first inkjet cartridge and the second inkjet cartridge, respectively.

10. A method of preventing misplacing inkjet cartridge, adapted for an inkjet apparatus, the inkjet apparatus having a carriage equipped with a first inkjet cartridge and a second inkjet cartridge, the first inkjet cartridge and the second inkjet cartridge respectively having a first identifiable area and a second identifiable area, wherein the colors of the first identifiable area and the second identifiable area are associated with the colors of ink stored in the first inkjet cartridge and the second inkjet cartridge, the method comprising the steps of:

detecting the colors of the first identifiable area and the second identifiable area by a sensor disposed in the carriage;

sending a first signal and a second signal;

receiving the first signal and the second signal; and determining whether the first inkjet cartridge and the second inkjet cartridge are correctly placed.

11. The method according to claim 10, further comprising a step of:

sending a warning signal to alert a user while the first inkjet cartridge or the second inkjet cartridge is misplaced.

12. The method according to claim 10, wherein the first inkjet cartridge has a first flexible PCB and the second inkjet cartridge has a second flexible PCB, wherein the first identifiable area and the second identifiable area are disposed at the first flexible PCB and the second flexible PCB, respectively.

13. The method according to claim 10, wherein the first inkjet cartridge has a first surface and the second inkjet cartridge has a second surface, wherein the first identifiable area and the second identifiable area are located at the first surface and the second surface, respectively.

14. An inkjet apparatus, having a carriage equipped with at least an inkjet cartridge, the inkjet cartridge having an identifiable area, and the color of the identifiable area is associated with the colors of ink stored in the inkjet cartridge, the inkjet apparatus comprising:

a sensor disposed in the carriage, for detecting the color of the identifiable area and sending a signal; and a control unit, for receiving the signal and determining whether the inkjet cartridge is correctly placed.

15. The inkjet apparatus according to claim 14, wherein the sensor is a charged coupling device (CCD).

16. The inkjet apparatus according to claim 14, wherein the sensor is a contact image sensor (CIS).

17. The inkjet apparatus according to claim 14 further comprising a housing, wherein the sensor is disposed in an inside wall of the housing.

18. The inkjet apparatus according to claim 14, wherein the inkjet cartridge further comprises a flexible PCB, and the identifiable area is formed at the flexible PCB.

19. The inkjet apparatus according to claim 14 wherein the inkjet cartridge further comprises a surface and the identifiable area is located at the surface of the inkjet cartridge.

20. The inkjet apparatus according to claim 14, wherein the signal is wirelessly transmitted between the control unit and the sensor.

21. A method of preventing misplacing inkjet cartridge, adapted for an inkjet apparatus, the inkjet apparatus having a carriage equipped with an inkjet cartridge, the inkjet cartridge having an identifiable area, wherein the color of the identifiable area is associated with the color of ink stored in the inkjet cartridge, the method comprising the steps of:

detecting the color of the identifiable area by a sensor disposed in the carriage, and sending a signal; and receiving the signal and determining whether the inkjet cartridge is correctly placed.

22. The method according to claim 21, further comprising a step of:

sending a warning signal to alert a user while the inkjet cartridge is misplaced.

23. The method according to claim 21, wherein the inkjet apparatus comprises a control unit to receive the signal and determine whether the inkjet cartridge is misplaced.

24. The method according to claim 21, wherein the inkjet cartridge has a flexible PCB, and the identifiable area is formed at the flexible PCB.

25. The method according to claim 21, wherein the inkjet cartridge has a surface and the identifiable area is located at the surface of the inkjet cartridge.

26. An inkjet apparatus, having a carriage equipped with at least an inkjet cartridge, the inkjet cartridge having an identifiable area, and the color of the identifiable area is associated with the colors of ink stored in the inkjet cartridge, the inkjet apparatus comprising:

a CIS sensor, for detecting the color of the identifiable area and sending a signal according to the detected color; and a control unit, for receiving the signal and determining whether the inkjet cartridge is correctly placed based on the received signal.

27. An inkjet apparatus, having a carriage equipped with at least an inkjet cartridge, the inkjet cartridge having an identifiable area, and the color of the identifiable area is associated with the colors of ink stored in the inkjet cartridge, the inkjet apparatus comprising:

a sensor, for detecting the color of the identifiable area and sending a signal according to the detected color;

a control unit, for receiving the signal and determining whether the inkjet cartridge is correctly placed based on the received signal;

wherein the signal is wirelessly transmitted between the control unit and the sensor.

28. A method of preventing misplacing inkjet cartridge, adapted for an inkjet apparatus, the inkjet apparatus having a carriage equipped with a first inkjet cartridge and a second inkjet cartridge, the first inkjet cartridge and the second inkjet cartridge respectively having a first identifiable area and a second identifiable area, wherein the colors of the first identifiable area and the second identifiable area are associated with the colors of ink stored in the first inkjet cartridge and the second inkjet cartridge, the method comprising the steps of:

detecting the colors of the first identifiable area and the second identifiable area;

sending a first signal and a second signal according to the detected colors of the first identifiable area and the second identifiable area, respectively;

receiving the first signal and the second signal; and determining whether the first inkjet cartridge and the second inkjet cartridge are correctly placed based on the received first signal and a second signal, respectively;

wherein the first inkjet cartridge has a first flexible PCB and the second inkjet cartridge has a second flexible PCB, wherein the first identifiable area and the second identifiable area are disposed at the first flexible PCB and the second flexible PCB, respectively.

29. An inkjet apparatus, having a carriage equipped with at least an inkjet cartridge, the inkjet cartridge having an identifiable area, and the color of the identifiable area is associated with the colors of ink stored in the inkjet cartridge, the inkjet apparatus comprising:

a sensor disposed in the carriage, for detecting the color of the identifiable area and sending a signal according to the detected color; and a control unit, for receiving the signal and determining whether the inkjet cartridge is correctly placed based on the received signal;

wherein the inkjet cartridge further comprises a flexible PCB, and the identifiable area is formed at the flexible PCB.

30. A method of preventing misplacing inkjet cartridge, adapted for an inkjet apparatus, the inkjet apparatus having a carriage equipped with an inkjet cartridge, the inkjet cartridge having an identifiable area, wherein the color of the identifiable area is associated with the color of ink stored in the inkjet cartridge, the method comprising the steps of:

detecting the color of the identifiable area by a sensor disposed in the carriage, and sending a signal according to the detected color; and receiving the signal and determining whether the inkjet cartridge is correctly placed based on the received signal;

wherein the inkjet cartridge has a flexible PCB, and the identifiable area is formed at the flexible PCB.

31. An inkjet apparatus, comprising:

a carriage;

at least an inkjet cartridge disposed in the carriage, the inkjet cartridge having an identifiable area, and the color of the identifiable area is identical to the color of ink stored in the inkjet cartridge;

a sensor, for detecting the color of the identifiable area and sending a signal according to the detected color; and a control unit, for receiving the signal and determining whether the inkjet cartridge is correctly placed based on the received signal.

32. The inkjet apparatus according to claim 31, wherein the sensor is disposed in the carriage.

33. The inkjet apparatus according to claim 31, wherein the inkjet cartridge further comprises a flexible PCB, and the identifiable area is on the flexible PCB.

34. The inkjet apparatus according to claim 31, wherein the inkjet cartridge further comprises a surface and the identifiable area is located at the surface of the inkjet cartridge.

35. A method of preventing misplacing inkjet cartridge, adapted for an inkjet apparatus, the inkjet apparatus having a carriage equipped with an inkjet cartridge, the inkjet cartridge having an identifiable area, wherein the color of the identifiable area is identical to the color of ink stored in the inkjet cartridge, the method comprising the steps of:

detecting the color of the identifiable area and sending a signal according to the detected color; and receiving the signal and determining whether the inkjet cartridge is correctly placed, based on the received signal.

36. The method according to claim 35, wherein the inkjet apparatus has a sensor to detect the color of the identifiable area and send the signal, wherein the sensor is disposed in the carriage.

37. The method according to claim 35, wherein the inkjet cartridge has a flexible PCB, and the identifiable area is formed at the flexible PCB.

38. The method according to claim 35, wherein the inkjet cartridge has a surface and the identifiable area is located at the surface of the inkjet cartridge.

* * * * *